US006135806A

United States Patent [19]

Pohjola

[11] Patent Number: 6,135,806

[45] Date of Patent: Oct. 24, 2000

[54] JUNCTION BETWEEN AN INTELLIGENT CONTACT TERMINAL AND A CABLE

[75] Inventor: Jorma Pohjola, Varjakka, Finland

[73] Assignee: Oy IWS International, Inc., Kempele, Finland

[21] Appl. No.: 09/194,255

[22] PCT Filed: May 27, 1997

[86] PCT No.: PCT/FI97/00320

§ 371 Date: Jul. 15, 1999

§ 102(e) Date: Jul. 15, 1999

[87] PCT Pub. No.: WO97/45895

PCT Pub. Date: Dec. 4, 1997

[30] Foreign Application Priority Data

May 27, 1996 [FI] Finland ..... 962210

[51] Int. Cl.[7] ..... H01R 4/24

[52] U.S. Cl. ..... 439/425; 439/422

[58] Field of Search ..... 439/425, 422, 439/426

[56] References Cited

U.S. PATENT DOCUMENTS 3,713,072 1/1973 Henschen et al. ..... 439/425

FOREIGN PATENT DOCUMENTS

| | | |
|---|---|---|
| 0 697 751 A1 | 2/1996 | European Pat. Off. . |
| 41 18 935 | 12/1992 | Germany . |
| 44 36 829 A1 | 4/1996 | Germany . |
| 1 267 710 | 3/1972 | United Kingdom . |
| 2 208 044 | 2/1989 | United Kingdom . |
| WO 95/15594 | 6/1995 | WIPO . |

*Primary Examiner*—Paula Bradley
*Assistant Examiner*—Tho D. Tu
*Attorney, Agent, or Firm*—Jacobson, Price, Holman & Stern, PLLC

[57] ABSTRACT

This invention relates to a junction between an intelligent contact terminal (3) and a cable (1, 2), said junction comprising connector pins (4) extending from the contact terminal (3), penetrating into a cable insulation sheath (1) and piercing flat wires (2) included in the cable and provided with lip portions (10) pressing against the lateral faces of the pins. In order to provide a secure contact, the pins (4) are slightly conical or tapered at least within the region of said lip portions (10). By designing the flat wire as a multilayer wire, the lip portions (10) of the wire layers together can be brought to provide an increased contact area. In addition, the multilayer wire (2) is penetrable with a lesser application of force if the cable is provided with preliminary holes for the pins (4).

3 Claims, 2 Drawing Sheets

JUNCTION BETWEEN AN INTELLIGENT CONTACT TERMINAL AND A CABLE

BACKGROUND OF THE INVENTION

1. Field of the Invention

The present invention relates to a junction between an intelligent contact terminal and a cable, said junction comprising connector pins extending from the contact terminal, penetrating into a cable insulation sheath and piercing flat wires included in the cable and provided with lip portions pressing against the lateral faces of the pins.

2. Brief Summary of the Invention

This type of pin junction is known from the Applicant's international patent application WO 95/15594.

An object of the invention is to develop this junction further in order to provide a more secure contact also over a longer period of time.

This object is achieved with a junction of the invention in such a manner that the pins are slightly conical or tapered at least over said lip portions. The conicity of the pins presses the lip portions to a pretensioned state against the elastic insulation of a cable, whereby the junction does not slacken even over a longer period of time. This only requires a very slight conicity or tapering, which is preferably just about 0.1 mm (typically within the range of 0.5–0.3 mm) over the length of 5 mm.

The junction can be further improved by increasing the contact area of the junction. This is performed in a junction of the invention in such a manner that the flat wire is multilayered and, thus, at a junction between the wire and the pin, the lip portions of several wire layers together create an increased contact area which presses against the slightly conical or tapered lateral face of a connecting pin.

The invention will now be described in more detail with reference made to the accompanying drawing, in which

DETAILED DESCRIPTION OF THE INVENTION

Figure 1:
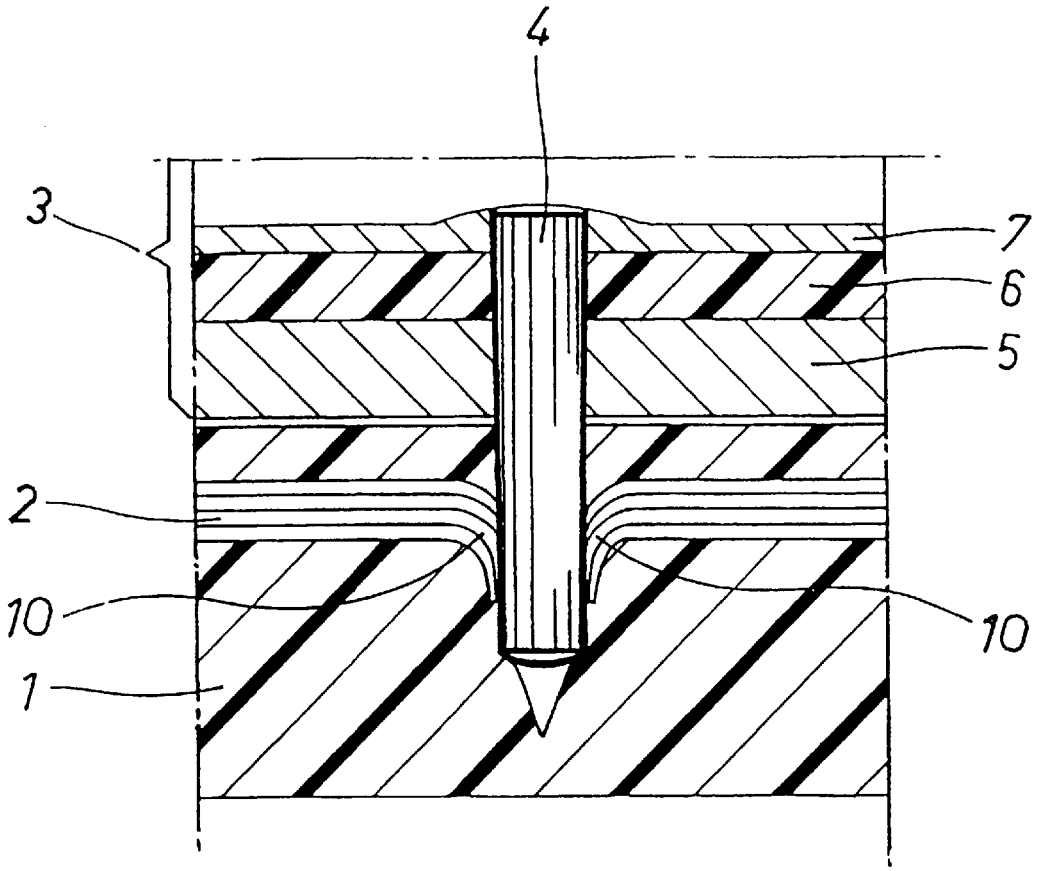
FIG. 1 shows a section taken at a junction of the invention in an enlarged scale.
Figure 2:
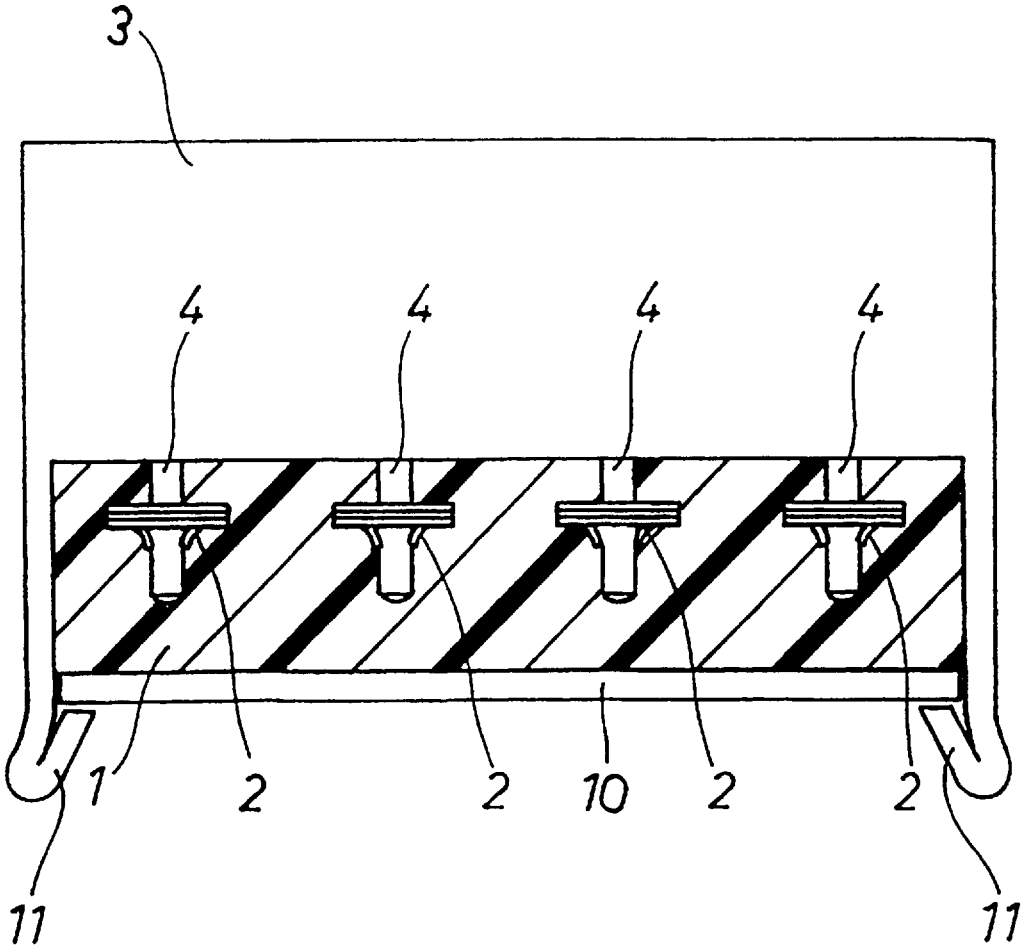
FIG. 2 shows a cable in cross-section at the junction.

When developing intelligent wiring systems in vehicles, the junction between an intelligent contact terminal and a cable has a major significance for the successful setup of an entire wiring system. The junction must be such that it can be readily produced in automatic manufacturing simply by pressing the contact terminal in place into the cable. On the other hand, the junction must be such that a damaged contact terminal can be replaced with a new one whenever necessary. A particular requirement for the junction is that it must sustain a secure contact even for quite long periods of time. Yet another requirement is that the junction must have a contact area as large as possible in order to avoid transfer resistance and heating caused thereby. All these requirements can be satisfied by means of a junction as described hereinbelow.

An intelligent contact terminal 3 contains necessary electronics (not shown) for controlling the supply of electricity from cable wires 2 to actuators (not shown) connected to the terminal 3. Some of the cable wires 2 are current conductors and some are code conductors, through the intermediary of which the terminal 3 receives its control commands.

The terminal 3 includes connecting pins 4, which extend through a case bottom 5 and attach to a conductor 7 on top of a circuit board 6. Through the intermediary of the conductors 7 the various pins 4 link with electronic components included in the contact terminal 3.

In the present case, the cable 1 includes four flat wires 2 which are surrounded by an insulation sheath 1. The wires can be pre-holed by means of a pointed instrument, having a diameter which is slightly smaller than that of the pin 4 to be pushed into the hole.

The preliminary hole can be made multi-sequentially by first using a smaller pointed tool for making a hole, which is then extended with a second tool. If the hole is made in a single operation, it is necessary to employ a longer tool capable of piercing the entire cable in order not to make the wedge angle too sharp and the force required for piercing too great. The wire 2 must be pierced with as low a force as possible in order not to bend it beyond the reach of the pin 4.

Upon piercing the wire 2, the tool presses the edges of a developing hole into lip portions 10, which squeeze tightly against the lateral faces of the pin 4 because the elastic material of the insulation sheath 1 urges the lip portions 10) towards the pin 4. It has turned out, however, that a sufficient compression does not develop between the junction surfaces if the pins 4 have straight cylindrical surfaces. According to the invention, the pins 4 are slightly conical or tapered at least within the region of the lip portions 10 whereby the compressive force in the junction increases as the pin 4 is being pushed into its position in a preliminary hole made by a tool. The conicity must be extremely slight as its primary purpose is to replace the material that is removed from the contact surfaces as a result of attrition between the surfaces as the pin 4 is pushed in position. It is quite sufficient that over the length of 5 mm the pin 4 has a conicity or tapering within the range of 0.5–0.3 mm, typically about 0.1 mm. The conicity or tapering should not be such that it will weaken the mechanical attachment of the pin 4 to a cable. When using a junction of the invention, the contact terminal 3 can be secured to the cable 1, 2 mechanically by means of the pin connection 4. The attachment can be effected simply by pushing the contact terminal 3 in its position. After that, the pin connection prevents detachment of the contact terminal 3 from the cable 1, 2 without significant application of force. However, a damaged contact terminal 3 can be replaced by pulling the contact terminal 3 off the cable by means of a suitable tool. In the described case, the attachment between the terminal 3 and the cable 1 is nevertheless secured by means of a base plate 10, which grips behind bent edges 11 of the case. The base plate 10 is necessary if the preliminary holes have been made by means of long pins piercing the entire cable 1, whereby the inner surface of the base plate 10 at the holes can be provided with an insulating tape or compound.

By virtue of the preliminary holes, the pins 4 may be blunt-ended with no hazard of breaking through the cable sheath 1.

In addition to the conicity of the pins 4, another essential feature of the invention is that the flat wires 2 are multilayered. In the present case, the number of layers is four. Each layer may have a thickness of e.g. 0.2 mm, resulting in a wire thickness of 0.8 mm. The multilayer cable design offers a number of benefits. First of all, it resists the making of a preliminary hole with a force which is substantially lower than what is the case with a single-layer conductor of the same thickness. The breakthrough-resisting force is typically ¼–½ of the force that would be required for a single-layer conductor. As a result of this, the wire 2 does not undergo any major displacement in front of the piercing pin but remains in the proximity of the top cable surface, whereby the pin 4 extends through the wire 2. If the wire 2 should move in front of the piercing pin to the proximity of the bottom surface of the cable sheath 1, the pin 4 would not always extend sufficiently far to pierce a hole in the wire 2.

The multilayer design of the wire 2 provides yet another important advantage. The lip portions 10 of several wire layers provide an increased contact area at the junction. For example, the use of four layers doubles the contact area as compared with a single-layer wire.

All these aspects together, i.e. conicity of the pin 4, reduction of the piercing force, and increase of the contact surface make it possible that the above-mentioned objects can be fulfilled.

The contact security and contact durability can be further increased by coating the pin 4 with a soft, highly conductive metal, such as gold or bismuth, which fills all microscopically tiny voids in the contact surface and provides a good contact with a low transfer resistance.

What is claimed is:

1. A junction between an intelligent contact terminal (3) and a cable (1, 2), said junction comprising at least two blunt-ended connector pins (4) extending from the intelligent contact terminal (3), the at least two blunt-ended connector pins (4) having been forced into preliminary holes, made in the cable (1, 2) with a pointed tool and said preliminary holes in said cable having a diameter which is slightly smaller than that of the at least two blunt-ended connector pins (4), said at least two blunt-ended connector pins having slightly conical or tapered side face and penetrating into a cable insulation sheath (1) and at least two flat conductors of said cable through said preliminary holes, said at least two blunt-ended connector pins piercing said at least two flat conductors, said at least two flat conductors included in the cable and provided with lip portions (10) pressing against the lateral faces of the pins, the blunt ends of the connector pins (4) remaining inside the cable sheath (1), wherein each of the flat conductors (2) forms a single multilayered conductor whereby, at a junction between the conductor (2) and the pin (4), the lip portions (10) produce an increased contact area which presses against said slightly conical or tapered side face of the connector pin (4).

2. A junction as set forth in claim 1, wherein, over the length of 5 mm, the pin has a conicity or tapering which is 0.5–0.3 mm.

3. A junction as set forth in claim 1 or 2, wherein the pins (4) are coated with a highly conductive, soft metal, such as gold or bismuth.

* * * * *